US010907343B1

(12) United States Patent
Mou et al.

(10) Patent No.: US 10,907,343 B1
(45) Date of Patent: Feb. 2, 2021

(54) PREFABRICATED STEEL-WOOD COMPOSITE JOINT

(71) Applicant: QINGDAO UNIVERSITY OF TECHNOLOGY, Qingdao (CN)

(72) Inventors: Ben Mou, Qingdao (CN); Fei Zhao, Qingdao (CN); Peng Feng, Qingdao (CN); Qiyun Qiao, Qingdao (CN); Bingcheng Yan, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 16/977,089

(22) PCT Filed: Sep. 30, 2019

(86) PCT No.: PCT/CN2019/109296
§ 371 (c)(1),
(2) Date: Aug. 31, 2020

(87) PCT Pub. No.: WO2020/173093
PCT Pub. Date: Sep. 3, 2020

(30) Foreign Application Priority Data

Feb. 27, 2019 (CN) ..... 2019 1 0144340

(51) Int. Cl.
*E04B 1/30* (2006.01)
*E04B 1/58* (2006.01)
(Continued)

(52) U.S. Cl.
CPC ..... *E04B 1/30* (2013.01); *E04B 1/5831* (2013.01); *E04B 1/98* (2013.01); *E04C 3/292* (2013.01);
(Continued)

(58) Field of Classification Search
CPC . E04B 1/30; E04B 1/98; E04B 1/5831; E04H 9/02; E04C 3/36; E04C 3/292; E04C 3/32
See application file for complete search history.

(56) References Cited

U.S. PATENT DOCUMENTS 3,938,294 A * 2/1976 Gaburri ..... E04B 1/30 52/742.14
5,660,017 A * 8/1997 Houghton ..... E04B 1/2403 52/167.3
(Continued)

FOREIGN PATENT DOCUMENTS

CN 108505619 A 9/2018
CN 108547379 A 9/2018
(Continued)

*Primary Examiner* — Rodney Mintz
(74) *Attorney, Agent, or Firm* — Bayramoglu Law Offices LLC

(57) ABSTRACT

A prefabricated steel-wood composite joint includes square pipe columns, steel-wood composite beams, and a beam-column connecting assembly for connecting the square pipe columns and the steel-wood composite beams. Each square pipe column includes connecting corner columns and connecting side plates. Each steel-wood composite beam includes a top flange, a bottom flange and wood webs for connecting the top flange and the bottom flange. The beam-column connecting assembly is a central column connecting assembly or a corner column connecting assembly. By a special structural design, the composite joint realizes effective beam-column connection without a welded connection and a bolted connection and has tenacity and good seismic performance. The components of the composite joint can be prefabricated in a factory, are high in precision and are assembled on site, so that construction is easy and convenient, procedures are simplified, and the construction period is effectively shortened.

8 Claims, 10 Drawing Sheets

(51) Int. Cl.

| | |
|---|---|
| ***E04B 1/98*** | (2006.01) |
| ***E04C 3/32*** | (2006.01) |
| ***E04C 3/36*** | (2006.01) |
| ***E04H 9/02*** | (2006.01) |
| ***E04C 3/292*** | (2006.01) |

(52) U.S. Cl.
CPC ..... *E04C 3/32* (2013.01); *E04C 3/36* (2013.01); *E04H 9/02* (2013.01)

(56) References Cited

U.S. PATENT DOCUMENTS 6,837,016 B2 * 1/2005 Simmons ..... E04B 1/2403 52/655.1
7,637,076 B2 * 12/2009 Vaughn ..... E04B 1/24 52/838
7,941,985 B2 * 5/2011 Simmons ..... E04B 1/24 52/655.1
8,359,797 B2 * 1/2013 Lee ..... E04B 1/04 52/259
8,474,204 B2 * 7/2013 Pan ..... E04B 1/165 52/259
8,549,805 B2 * 10/2013 Kim ..... E04C 5/0645 52/260
8,621,803 B2 * 1/2014 Efros ..... E04G 23/0237 52/391
9,879,413 B2 * 1/2018 Castelli ..... E04B 1/1903
10,006,212 B2 * 6/2018 Chen ..... E04B 1/34321
10,024,047 B2 * 7/2018 Zavitz ..... E04B 1/215
10,094,101 B1 * 10/2018 Jazzar ..... E04B 5/32
10,167,623 B2 * 1/2019 Mou ..... E04B 1/2403
10,260,224 B1 * 4/2019 Jazzar ..... E04G 11/48
10,378,197 B2 * 8/2019 Kurosawa ..... E04B 5/29
10,557,264 B2 * 2/2020 Zavitz ..... E04B 5/17
10,619,342 B2 * 4/2020 Zavitz ..... E04B 1/21
10,626,594 B2 * 4/2020 Yu ..... E04B 1/5812
10,633,851 B2 * 4/2020 Mou ..... E04B 1/185
10,822,789 B1 * 11/2020 Mou ..... E04B 5/023
2002/0166304 A1 * 11/2002 Pareti ..... E04C 3/36 52/655.2
2003/0041549 A1 * 3/2003 Simmons ..... E04B 1/2403 52/655.1
2007/0209314 A1 * 9/2007 Vaughn ..... F16B 9/01 52/838
2008/0295443 A1 * 12/2008 Simmons ..... E04B 1/24 52/655.1
2010/0031605 A1 * 2/2010 Hong ..... E04C 3/34 52/839
2011/0131908 A1 * 6/2011 Lee ..... E04B 5/023 52/283
2012/0304584 A1 * 12/2012 Pan ..... E04B 1/165 52/655.1
2013/0111839 A1 * 5/2013 Efros ..... E04G 23/0237 52/391
2014/0245693 A1 * 9/2014 Efros ..... E04B 1/26 52/741.4
2015/0191907 A1 * 7/2015 Efros ..... E04B 5/12 52/745.05
2016/0222643 A1 * 8/2016 Castelli ..... E04B 1/34384
2016/0230386 A1 * 8/2016 Zavitz ..... E04B 5/17
2017/0051495 A1 * 2/2017 Zavitz ..... E04B 1/4121
2017/0145708 A1 * 5/2017 Chen ..... E04B 1/34384
2017/0175376 A1 * 6/2017 Calderon Uriszar-Aldaca ..... E04B 1/215
2017/0314254 A1 * 11/2017 Houghton ..... E04B 1/2403
2018/0127966 A1 * 5/2018 Kurosawa ..... E04B 1/30
2018/0187407 A1 * 7/2018 Mou ..... E04B 1/2403
2018/0245329 A1 * 8/2018 Yu ..... E04B 1/2403
2018/0291612 A1 * 10/2018 Zavitz ..... E04C 5/0645
2019/0010695 A1 * 1/2019 Zavitz ..... E04C 5/0645
2019/0249409 A1 * 8/2019 Boyd ..... E04B 1/1912
2019/0376273 A1 * 12/2019 Mou ..... E04H 9/024
2020/0149288 A1 * 5/2020 Griechen ..... E04B 1/08
2020/0190799 A1 * 6/2020 Wong ..... E04C 1/24

FOREIGN PATENT DOCUMENTS

CN 108824698 A 11/2018
CN 108978869 A 12/2018
CN 109296077 A 2/2019
CN 109296079 A 2/2019
CN 109853739 A 6/2019
JP H10231561 A 9/1998
JP 2006097449 A 4/2006

* cited by examiner

PREFABRICATED STEEL-WOOD COMPOSITE JOINT

CROSS REFERENCE TO THE RELATED APPLICATIONS

This application is the national stage entry of International Application No. PCT/CN2019/109296, filed on Sep. 30, 2019, which is based upon and claims priority to Chinese Patent Application No. 201910144340.4, filed on Feb. 27, 2019, the entire contents of which are incorporated herein by reference.

TECHNICAL FIELD

The invention belongs to the technical field of connection of building structures, and particularly relates to a prefabricated steel-wood composite joint.

BACKGROUND

The rise of building industrialization makes prefabricated structures gradually become the primary development trend of buildings in the future. Compared with traditional welded connection and bolted connection, the prefabricated structures can be installed by workers who have received simple assembly training, and the construction quality can be guaranteed to the maximum extent. Steel-structured buildings have the advantages of being light, good in plasticity and tenacity, low in weight, good in seismic performance, and the like. However, steel structures are resistant to heat, but are not resistant to fires, are prone to rusting and poor in corrosion resistance, and have many quality problems caused by welding. Wood-structured buildings are featured by good durability and seismic performance, easily available materials and high construction speed, but have drawbacks in the aspect of fire protection and moisture protection.

Structure systems of a steel-wood composite structure are constructed by combining the steel structure and the wood structure. Such structural systems are firmer and more durable than traditional wood structure systems and more diversified than modern pure steel structures, thus having been applied to building designs more and more widely. The assembly, extension and connection method of steel-wood structure joints has a direct influence on the integrity and reliability of the structures. For example, Chinese Invention Patent Publication No. CN108978869A discloses a prefabricated steel-wood composite beam-column joint structure and a construction method thereof, and Chinese Invention Patent Publication No. CN108547379A discloses a prefabricated steel-wood connection joint. In both patents, steel and wood are combined to improve the bearing capacity and design operability.

SUMMARY

The invention provides a prefabricated steel-wood composite joint, which adopts different materials, fulfills productization, standardization and prefabrication of joint installation, effectively avoids quality problems caused by field welding, and improves the construction efficiency.

The invention is implemented through the following technical solution: a prefabricated steel-wood composite joint comprises square pipe columns, steel-wood composite beams, and a beam-column connecting assembly for connecting the square pipe columns and the steel-wood composite beams;

Each square pipe column comprises connecting corner columns and connecting side plates, wherein the connecting corner columns are steel columns with good corrosion resistance; the connecting side plates are wood plates, which have a higher bearing capacity per unit mass than steel structures, can reduce the weight of the entire structure to a certain extent and can prolong the overall lie; and the square pipe column is of a hollow pipe column structure formed by splicing the connecting corner columns and the connecting side plates;

Each steel-wood composite beam comprises a top flange, a bottom flange and wood webs for connecting the top flange and the bottom flange, wherein the top flange and the bottom flange are arranged in parallel and are both steel structures having flange insertion slots formed in inner sides, flange insertion heads matched with the flange insertion slots are formed in the top and bottom sides of the wood webs, and the wood webs are arranged between the top flange and the bottom flange and are perpendicular to the top flange and the bottom flange; the number of the wood webs is two, and the two wood webs are spaced from each other by a distance to facilitate pipe laying and to prevent local bending of the flanges; and each wood web has an end flush with the side faces of the top and bottom flanges and an end recessed in the top and bottom flanges and provided with a stepped connecting head; and The beam-column connecting assembly is a central column connecting assembly or a corner column connecting assembly, is used for connecting the square pipe columns and the steel-wood composite beams, and comprises a square solid wood column matched with the square pipe columns in inner diameter, square wood beams are arranged on the side faces of the square solid wood column, connecting slots matched with the connecting heads are formed in the ends of the square wood beams, and the square pipe columns and the steel-wood composite beams are connected through the square solid wood column and the square wood beams.

Furthermore, the cross section of each connecting corner column is of an arc structure, dovetail insertion holes are formed in the edges of two sides of each connecting corner column, dovetail insertion heads matched with the dovetail insertion holes are correspondingly arranged on the side edges of the connecting side plates, and the dovetail insertion heads are interested into the dovetail insertion holes to integrally connect the connecting corner columns and the connecting side plates.

Furthermore, considering that the lengths of different wood pieces are inconsistent, the connecting side plates are assembled by splicing wood plates with different heights to make more use of materials. Particularly, each connecting side plate comprises an upper wood plate and a lower wood plate, wherein a linear insertion head is arranged at the lower end of the upper wood plate, a concave slot matched with the linear insertion head is formed in the upper end of the lower wood plate, and the upper wood plate is inserted into the lower side plate to be as high as the connecting corner columns.

Furthermore, the central column connecting assembly comprises the square solid wood column and two sets of first square wood beams which are correspondingly arranged in a skew-symmetric manner, wherein T-shaped slots are formed in one pair of opposite sides of the square solid wood column, and first through holes penetrating through the square solid wood column are formed in the T-shaped slots; and correspondingly, inverted T-shaped slots are formed in another pair of opposite sides of the square solid wood column, and second through holes penetrating through the square solid wood column are formed in the inverted T-shaped slots; and the first through holes are located in upper portions of the T-shaped slots, and the second through holes are located in lower portions of the inverted T-shaped slots, so that ingenious coordination is realized.

Furthermore, the two sets of first square wood beams include a first set of square wood beams and a second set of square wood beams, wherein the first set of square wood beams includes a first insertion head wood beam and a first special-shaped groove wood beam, a first strip-shaped insertion head is arranged on the first insertion head wood beam along the upper edge of a body of the first insertion head wood beam, a first special-shaped groove matched with the first strip-shaped insertion head in shape is formed in the upper surface of the first special-shaped groove wood beam, and after the first strip-shaped insertion head is inserted into the first through holes to be inlaid in the first special-shaped groove, two splicing slots are formed along two sides of the first special-shaped groove and are fixed with fixing wood sheets; and The second set of square wood beams includes a second insertion head wood beam and a second special-shaped groove wood beam, wherein a second strip-shaped insertion head is arranged on the second insertion head wood beam along the lower edge of a body of the second insertion head wood beam, a second special-shaped groove matched with the second strip-shaped insertion head in shape is formed in the lower surface of the second special-shaped groove wood beam, and after the second strip-shaped insertion head is inserted into the second through holes to be inlaid in the second special-shaped groove, two splicing slots are formed along two sides of the second special-shaped groove, that is, the first set of square wood beams and the second set of square wood beams are matched in design and are exactly connected integrally.

Furthermore, the corner column connecting assembly comprises the square solid wood column, two second square wood beams perpendicular to each other, and two wood wedges, wherein I-shaped slots are respectively formed in two adjacent sides of the square solid wood column, an upper portion of the I-shaped slot in one side penetrates through the entire solid wood column, a lower portion of the I-shaped slot in the other side penetrates through the entire solid wood column, I-shaped sliders matched with the I-shaped slots are arranged on the second square wood beams, the I-shaped slider on one second square wood beam is arranged along the upper edge of the second square wood beam, the I-shaped slider on the other second square wood beam is arranged along the lower edge of the second square wood beam, and wood wedge holes matched with the wood wedges are formed in the ends of the I-shaped sliders.

Furthermore, connecting slots corresponding to the connecting heads of the wood webs are formed in the tails of the first insertion head wood beam, the first special-shaped groove wood beam, the second insertion head wood beam, the second special-shaped groove wood beam and the second square wood beams; the wood beams with the strip-shaped insertion heads penetrate through the solid wood column to be connected to the corresponding wood beams with the special-shaped grooves, and the fixing wood sheets are inserted into the splicing slots at the junctions to fulfill integral connection; and the square wood beams with the I-shaped sliders are connected to the solid wood column along the I-shaped slots and are integrally fixed to the solid wood column with the wood wedges.

Furthermore, to further improve the connection strength, fixing slots are formed in two side faces of the first insertion head wood beam, the first special-shaped groove wood beam, the second insertion head wood beam, the second special-shaped groove wood beam and the second square wood beams, and the fixing wood sheets are arranged in the fixing slots. By inserting the fixing wood sheets into the fixing slots for assembly, the top flanges and the bottom flanges can be clamped on top and bottom sides of the wood beams to be fixed and matched with the wood beams.

Furthermore, the prefabricated steel-wood composite joint further comprises I-shaped sliding blocks and filling wood blocks, wherein T-shaped splicing slots are formed in lower sides of the first insertion head wood beam, the first special-shaped groove wood beam, the second insertion head wood beam, the second special-shaped groove wood beam and the second square wood beams, T-shaped through holes matched with the T-shaped splicing slots are correspondingly formed in the bottom flanges, a sliding space is formed in each T-shaped splicing slot, a splicing head matched with the sliding space is arranged on a lower portion of each I-shaped sliding block, the I-shaped sliding blocks are inserted into the T-shaped splicing slots and slide in the T-shaped splicing slots, and then the filling wood blocks are inserted into the T-shaped splicing slots to be fixed. In this way, the beam flanges and the beam-column connecting assembly are connected, and stress concentration caused by drilling is effectively reduced.

Compared with the prior art, the invention has the following advantages and beneficial effects:

The components of the composite joint of the invention can be prefabricated in factory, are high in precision and are assembled on site, so that construction is easy and convenient, procedures are simplified, and the construction period is effectively shortened; the utilization rate of materials with different strengths is increased by adopting the steel-wood composite structure; an efficient, reasonable and novel structural form of the steel-wood structure is formed through ingenious connection and coordination; and with the aid of local large steel structures, the degree of freedom of wood structures is effectively expanded, and the expression diversity of buildings is improved.

DETAILED DESCRIPTION OF THE EMBODIMENTS

To gain a better understanding of the purposes, features and advantages of the invention, the invention is further expounded below in conjunction with the accompanying drawings and embodiments.

Figure 1:
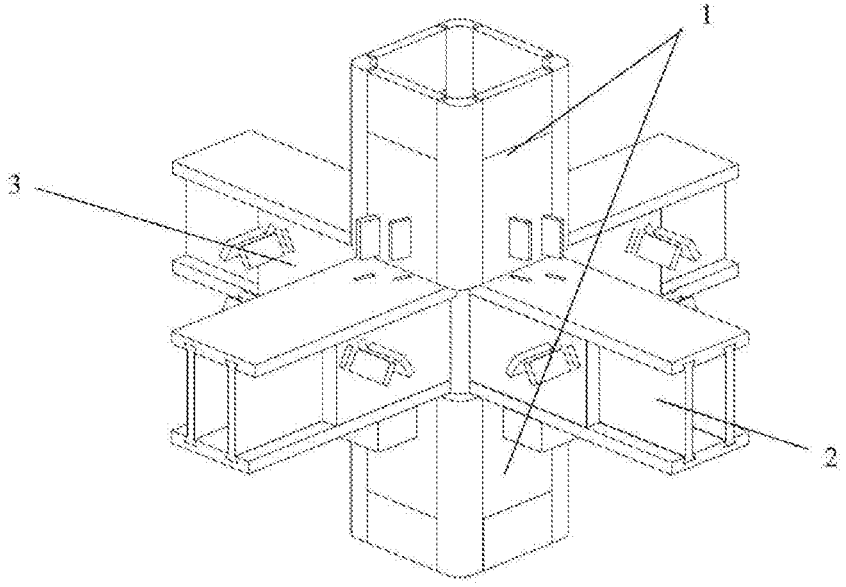
FIG. 1 is an overall structural view of a central column composite joint in Embodiment 1 of the invention.
Figure 10:
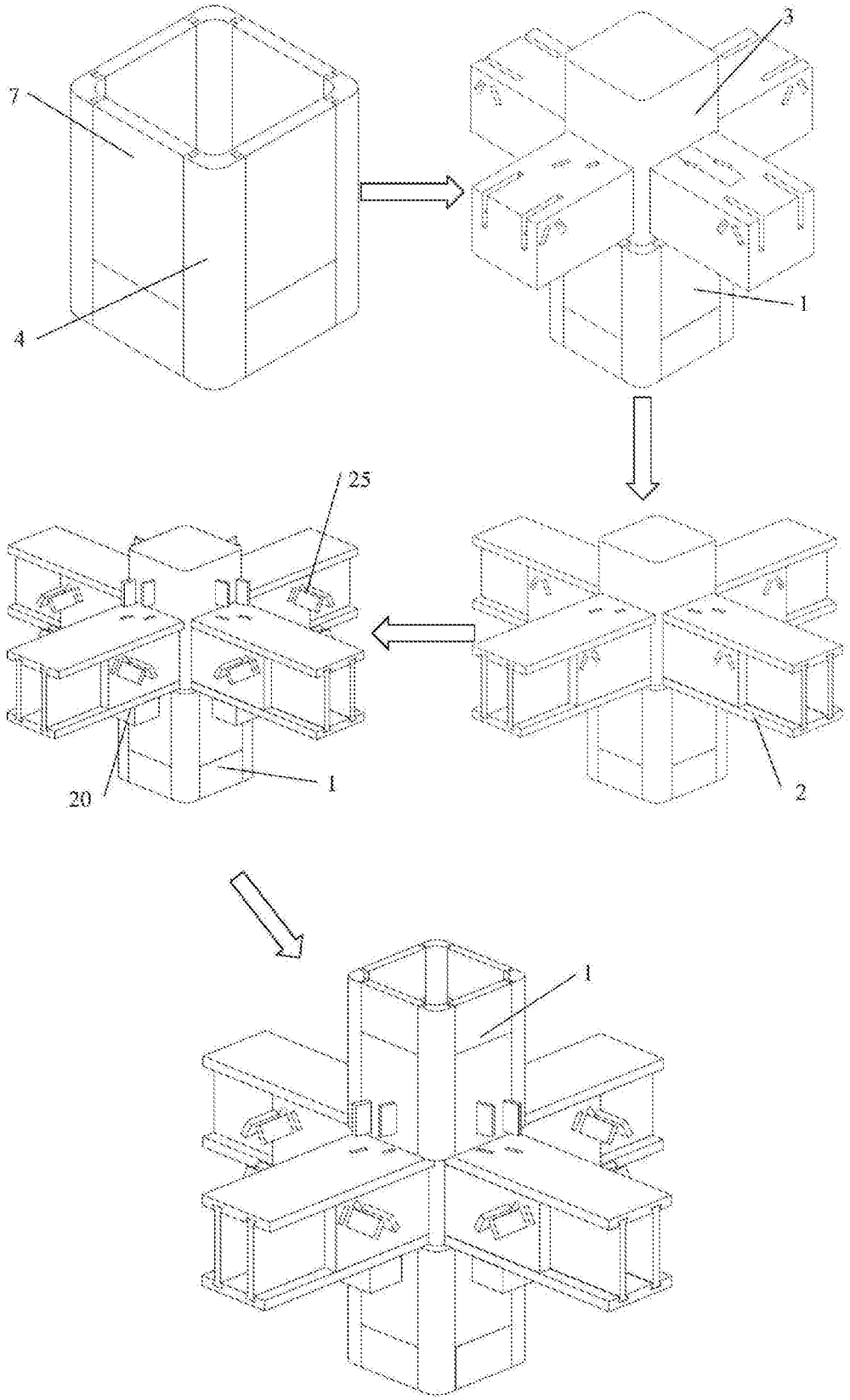
FIG. 10 is an assembly diagram of the central column composite joint in Embodiment 1 of the invention.

Embodiment 1 a prefabricated steel-wood composite joint, as shown in FIG. 1 and FIG. 10, comprises square pipe columns 1, steel-wood composite beams 2 and a beam-column connecting assembly 3 for connecting the square pipe columns 1 and the steel-wood composite beams 2.

Figure 2:
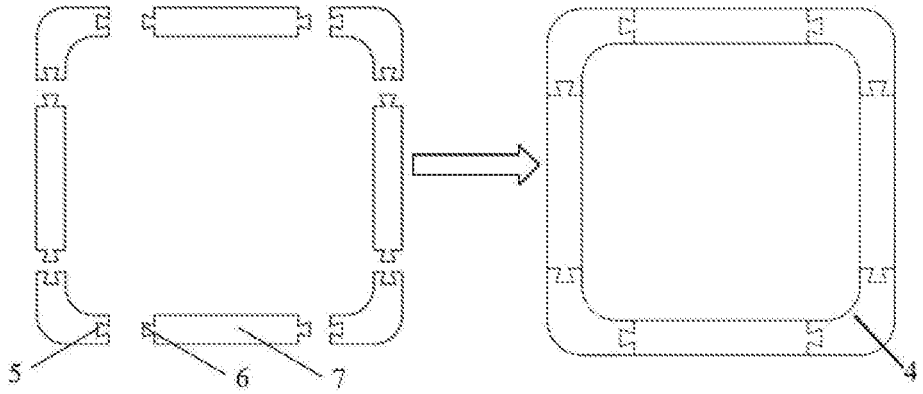
FIG. 2 is a first top view of a square pipe column in Embodiment 1 of the invention.
Figure 3:
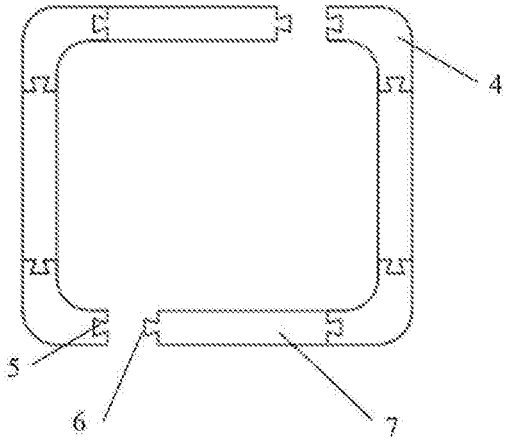
FIG. 3 is a second top view of the square pipe column in the embodiment of the invention.
Figure 4:
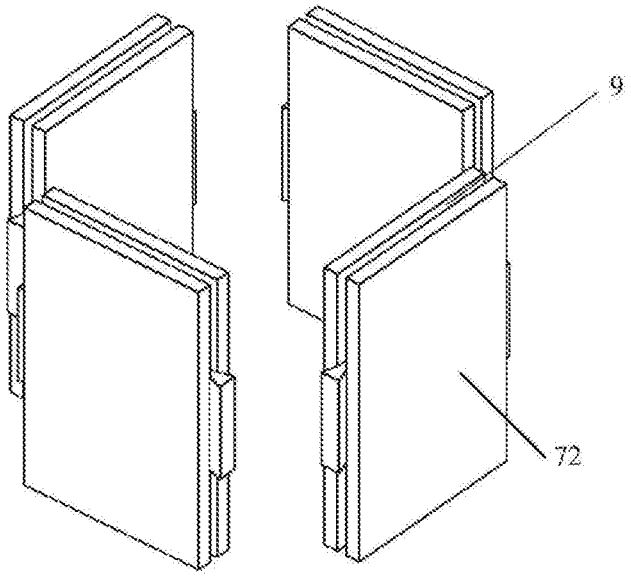
FIG. 4 is a structural view of lower wood plates of connecting side plates in Embodiment 1 of the invention.
Figure 5:
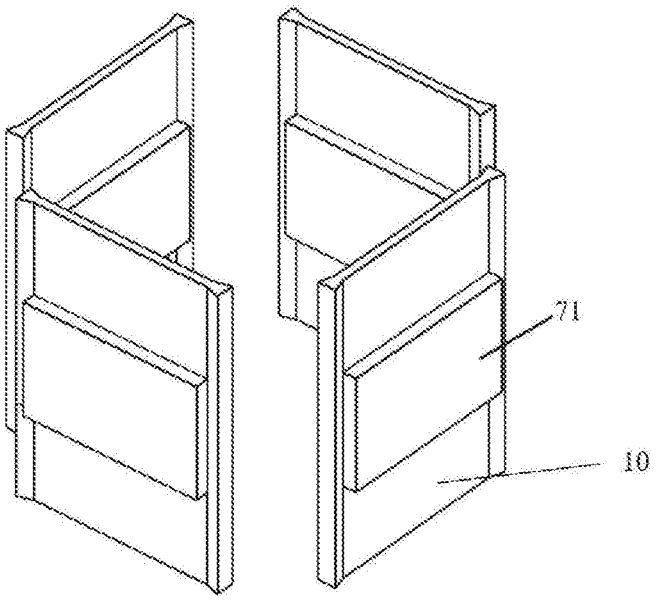
FIG. 5 is a structural view of upper wood plates of the connecting side plates in Embodiment 1 of the invention.
Figure 6:
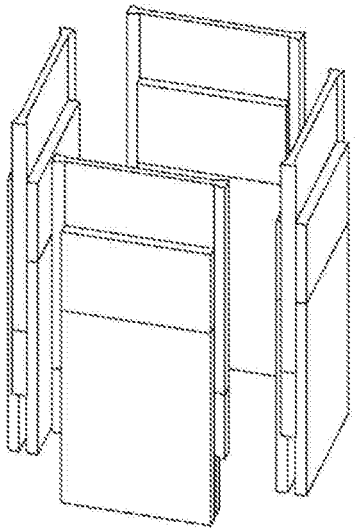
FIG. 6 is a structural view after the lower wood plates in FIG. 4 and the upper wood plates in FIG. 5 are assembled.

Each square pipe column 1 comprises connecting corner columns 4 and connecting side plates 7 and is of a hollow pipe column structure formed by splicing four connecting corner columns 4 and four connecting side plates 7 as shown in FIG. 2 and FIG. 3, wherein the connecting corner columns 4 are steel columns 4 with good corrosion resistance, and the connecting side plates 7 are wood plates 7. Compared with pure steel structures, the steel-wood composite columns have a higher bearing capacity per unit mass, can reduce the weight of the entire structure to a certain extent and can improve the overall life. The cross-section of each connecting corner columns 4 is of a 90° arc structure, and dovetail insertion holes 5 are formed in edges of two sides of each connecting corner column 4; and correspondingly, dovetail insertion heads 6 matched with the dovetail insertion holes 5 are arranged on the side edges of the connecting side plates 7, and the insertion heads 6 are inserted into the insertion holes 5 to integrally connect the connecting corner columns 4 and the connecting side plates 7. In addition, considering that the lengths of different wood pieces are inconsistent, the connecting side plates 7 may be assembled by splicing wood plates with different heights to make more use of materials. As shown in FIG. 4 and FIG. 5, each connecting side plate 7 comprises an upper wood plate 71 and a lower wood plate 72, wherein a linear insertion head 10 is arranged at the lower end of the upper wood plate 71, and a concave slot 9 matched with the linear insertion head 10 is formed in the upper end of the lower wood plate 72, and the upper wood plate 71 is inserted into the lower wood plate 72 to be as high as the connecting corner columns 4, and the structure formed after the upper wood plate 71 and the lower wood plate 72 are spliced is shown in FIG. 6.

Figure 8:
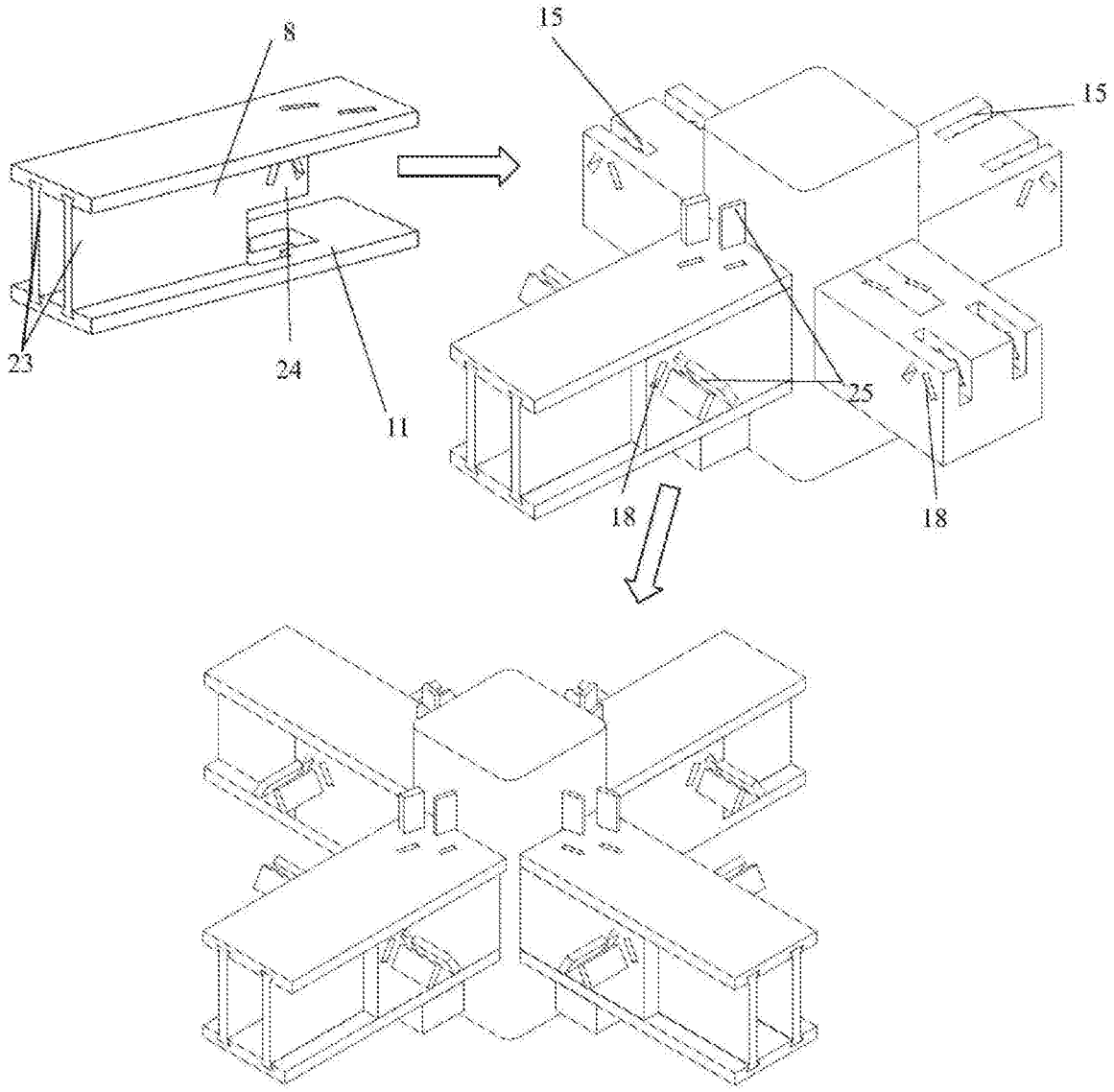
FIG. 8 is a connection diagram of steel-wood composite beams and the central beam-column connecting assembly in Embodiment 1.

As shown in FIG. 8, each steel-wood composite beam 2 comprises a top flange 8, a bottom flange 11, and wood webs 23 for connecting the top flange 8 and the bottom flange 11, wherein the top flange 8 and the bottom flange 11 are arranged in parallel and are both steel structures having flange insertion slots formed in inner sides, flange insertion heads matched with the flange insertion slots are arranged on upper and lower sides of the wood webs 23, the wood webs 23 are arranged between the top flange and the bottom flange and are perpendicular to the top flange and the bottom flange, the number of the wood webs 23 is two, and the two wood webs 23 are spaced from each other by a distance; and as shown in FIG. 8, the outer ends of the wood webs 23 are flush with the side faces of the top and bottom flanges, and the other ends of the wood webs 23 are recessed in the top and bottom flanges and are provided with stepped connecting heads 24. The design of spacing the two wood webs by a distance can facilitate pipe laying; and compared with traditional I-beams, the flanges will not locally bend, and the material utilization rate can be effectively increased.

Figure 7:
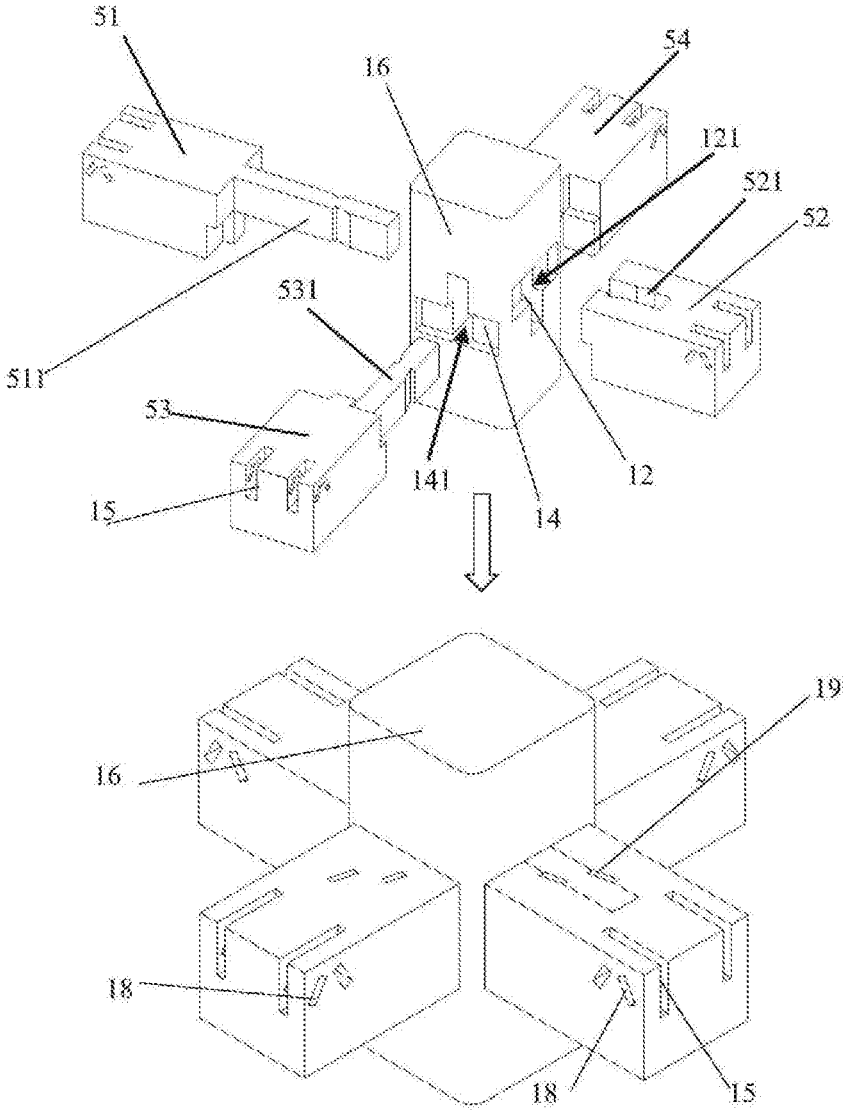
FIG. 7 is a structural view of a central beam-column connecting assembly in Embodiment 1.

In this embodiment, the beam-column connecting assembly 3 is a central column connecting assembly, which, as shown in FIG. 7, is of an all-wood structure to realize effective beam-column connection without welded connection and bolted connection, and has tenacity and good seismic performance.

Referring to FIG. 7, the central column connecting assembly comprises a square solid wood column 16 and two sets of first square wood beams which are correspondingly arranged in a skew-symmetric manner. T-shaped slots 12 are formed in one pair of opposite sides of the square solid wood column 16, and first through holes 121 penetrating through the entire square solid wood column 16 are formed in the T-shaped slots 12. Correspondingly, inverted T-shaped slots 14 are formed in the other pair of opposite sides of the square solid wood column 16, and second through holes 141 penetrating through the entire square solid wood column 16 are formed in the inverted T-shaped slots 14. In this embodiment, the first through holes 121 are located in upper portions of the T-shaped slots 12, and the second through holes 141 are located in lower portions of the inverted T-shaped slots, so that ingenious coordination is realized. The two sets of first square wood beams include a first set of square wood beams and a second set of square wood beams, wherein the first set of square wood beams includes a first insertion head wood beam 51 and a first special-shaped groove wood beam 52, a first strip-shaped insertion head 511 is arranged on the first insertion head wood beam 51 along the upper edge of a body of the first insertion head wood beam 51, the end face, with the first strip-shaped insertion head 511, of the first insertion head wood beam 51 is matched with the T-shaped slots, a first special-shaped groove 521 matched with the first strip-shaped insertion head 511 in shape is formed in the upper surface of the first special-shaped groove wood beam 52, and after the first strip-shaped insertion head 511 is inserted into the first through holes to be inlaid in the first special-shaped groove 521, two splicing slots 19 are formed along two sides of the first special-shaped groove; and the second set of square wood beams includes a second insertion head wood beam 53 and a second special-shaped groove wood beam 54, a second strip-shaped insertion head 531 is arranged on the second insertion head wood beam 53 along the lower edge of a body of the second insertion head wood beam 53, the end face of the second strip-shaped insertion head 531 is matched with the surfaces of the inverted T-shaped slots, a second special-shaped groove matched with the second strip-shaped insertion head 531 in shape is formed in the lower surface of the second special-shaped groove wood beam 52, and after the second strip-shaped insertion head 511 is inserted into the second through holes to be inlaid in the second-shaped groove, two splicing slots are formed along two sides of the second special-shaped groove, that is, the first set of square wood beams and the second set of square wood beams are matched in design to be exactly connected integrally. In addition, connecting slots 15 corresponding to the connecting heads 24 of the wood webs are formed in the tails of the four wood beams (51, 52, 53 and 54). The wood beams with the strip-shaped insertion heads penetrate through the solid wood column to be connected to the corresponding wood beams with the special-shaped grooves, and fixing wood sheets are inserted into the splicing slots at the junctions to fulfill integral connection.

Figure 9:
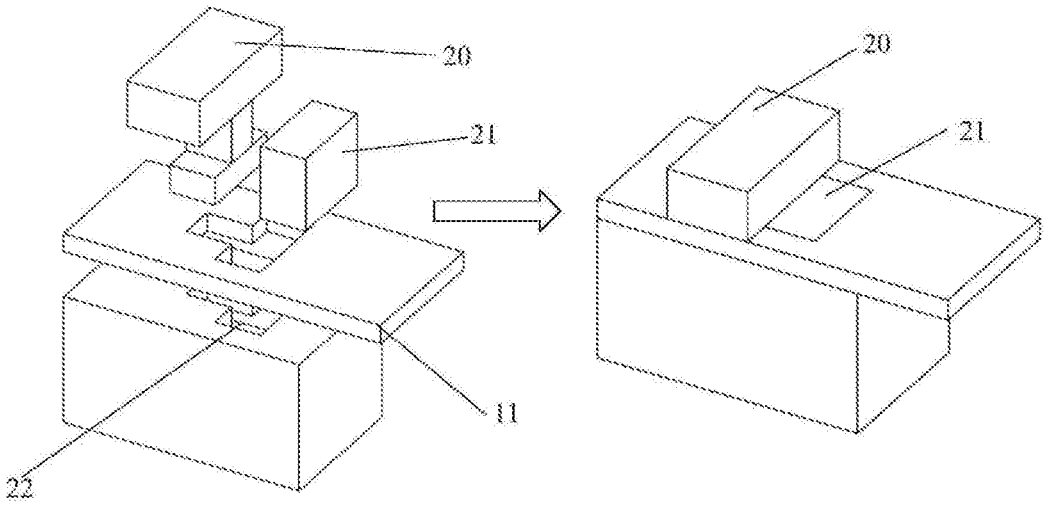
FIG. 9 is a structural view of a top flange fixed with an I-shaped sliding block in Embodiment 1.

As shown in FIG. 8 which is a connection diagram of the steel-wood composite beams 2 and the beam-column connecting assembly 3, the connecting heads 24 of the wood webs 23 are inserted into the connecting slots 15; and to further improve the connection strength, fixing slots 18 are formed in two sides of the four wood beams, and fixing wood sheets 25 are inserted into the fixing slots 18 for assembly, so that the top and bottom flanges are clamped on the top and bottom sides of the wood beams to be fixed and matched with the wood beams. As shown in FIG. 9 which is a local connection view of the bottom flanges 11 and the beam-column connecting assembly 3, a T-shaped splicing slot 22 is formed in the lower side of each of the four wood beams, T-shaped through holes matched with the T-shaped splicing slots are formed in the bottom flanges correspondingly, a sliding space is formed in each T-shaped splicing slot 22, a splicing head matched with the sliding space is arranged on a lower portion of each I-shaped sliding block 20, the I-shaped sliding blocks 20 are inserted into the T-shaped splicing slots and slide leftwards (in the direction shown in FIG. 9), and filling wood blocks 21 are inserted to be fixed, so that the beam flanges and the beam-column connecting assembly are connected, and stress concentration caused by drilling is effectively reduced.

As shown in FIG. 10 which is a schematic diagram of the specific assembly process of the prefabricated beam-column composite joint in this embodiment:

Step 1: the beam-column connecting assembly 3 and the square pipe columns are assembled separately, wherein the square pipe columns include an upper square pipe column and a lower square pipe column;

Step 2: the assembled beam-column connecting assembly 3 is inserted into the assembled lower square pipe column;

Step 3: the connecting heads of the wood webs are inserted into the connecting slots in the ends of the square wood beams;

Step 4: the top and bottom flanges are connected to the flange insertion heads on the top and bottom sides of the wood webs through the flange insertion holes, the top flanges are connected and fixed to the top sides of the wood webs through a set of fixing wood sheets, the two sides of the top flanges are fixed through the fixing wood sheets, and the bottom flanges are integrally connected to the square wood beams through the I-shaped sliding blocks and the filling wood blocks; and Step 5: the assembled upper square pipe column is inserted into the square solid wood column above the beam-column connecting assembly.

Figure 11:
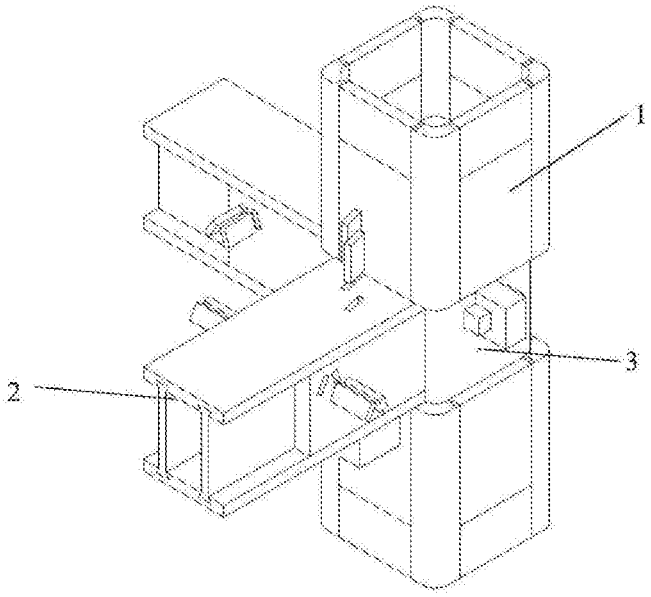
FIG. 11 is an overall structural view of a corner column composite joint in Embodiment 2 of the invention.
Figure 12:
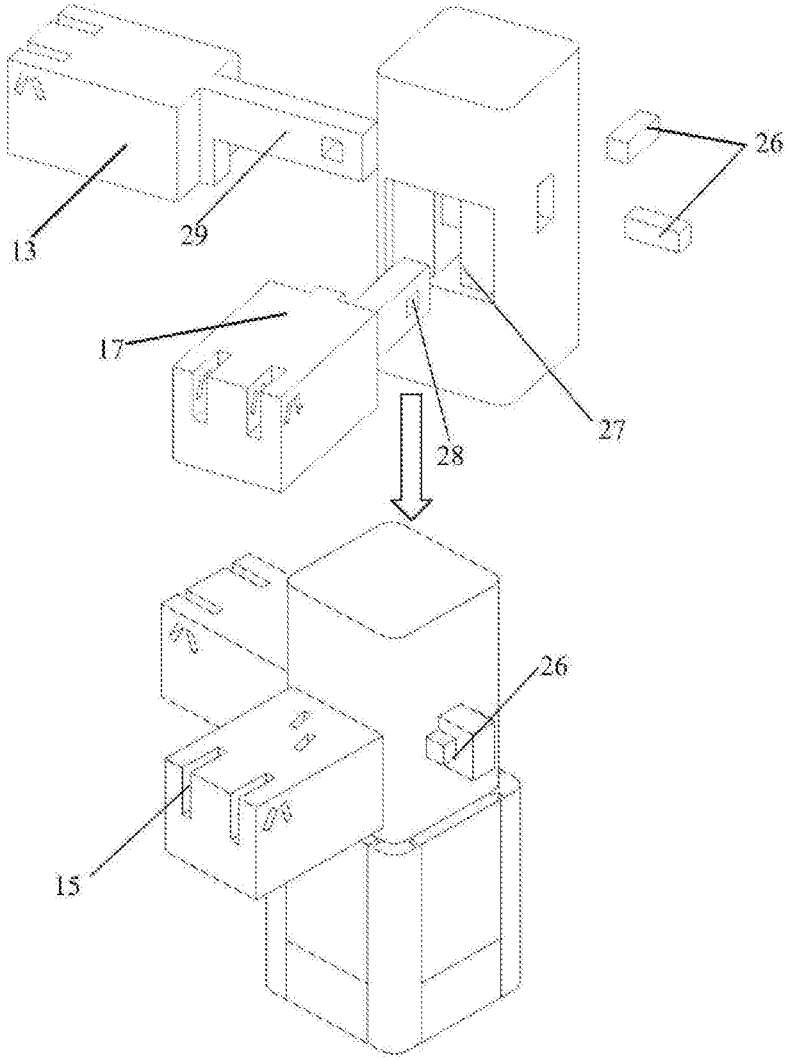
FIG. 12 is a structural view of a corner beam-column connecting assembly in Embodiment 2 of the invention.
Figure 13:
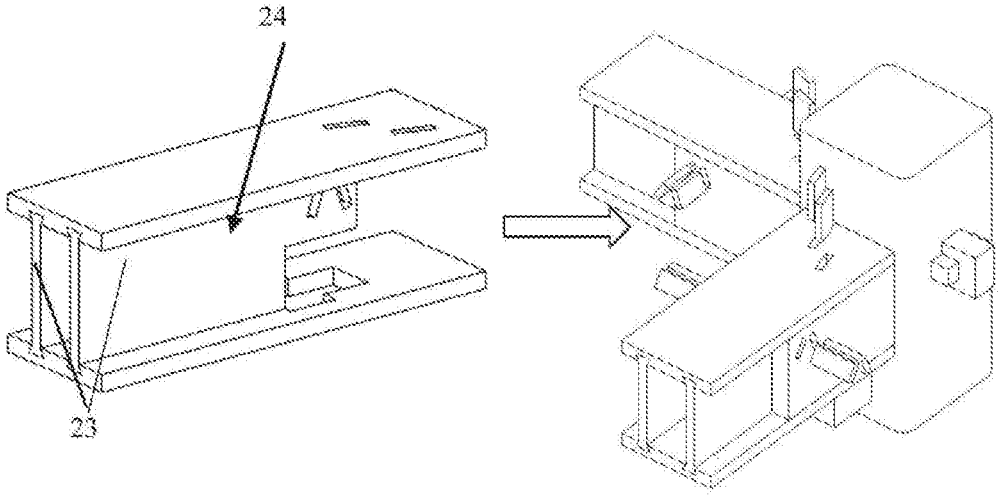
FIG. 13 is a connection diagram of steel-wood composite beams and the corner beam-column connecting assembly in Embodiment 2.
Figure 14:
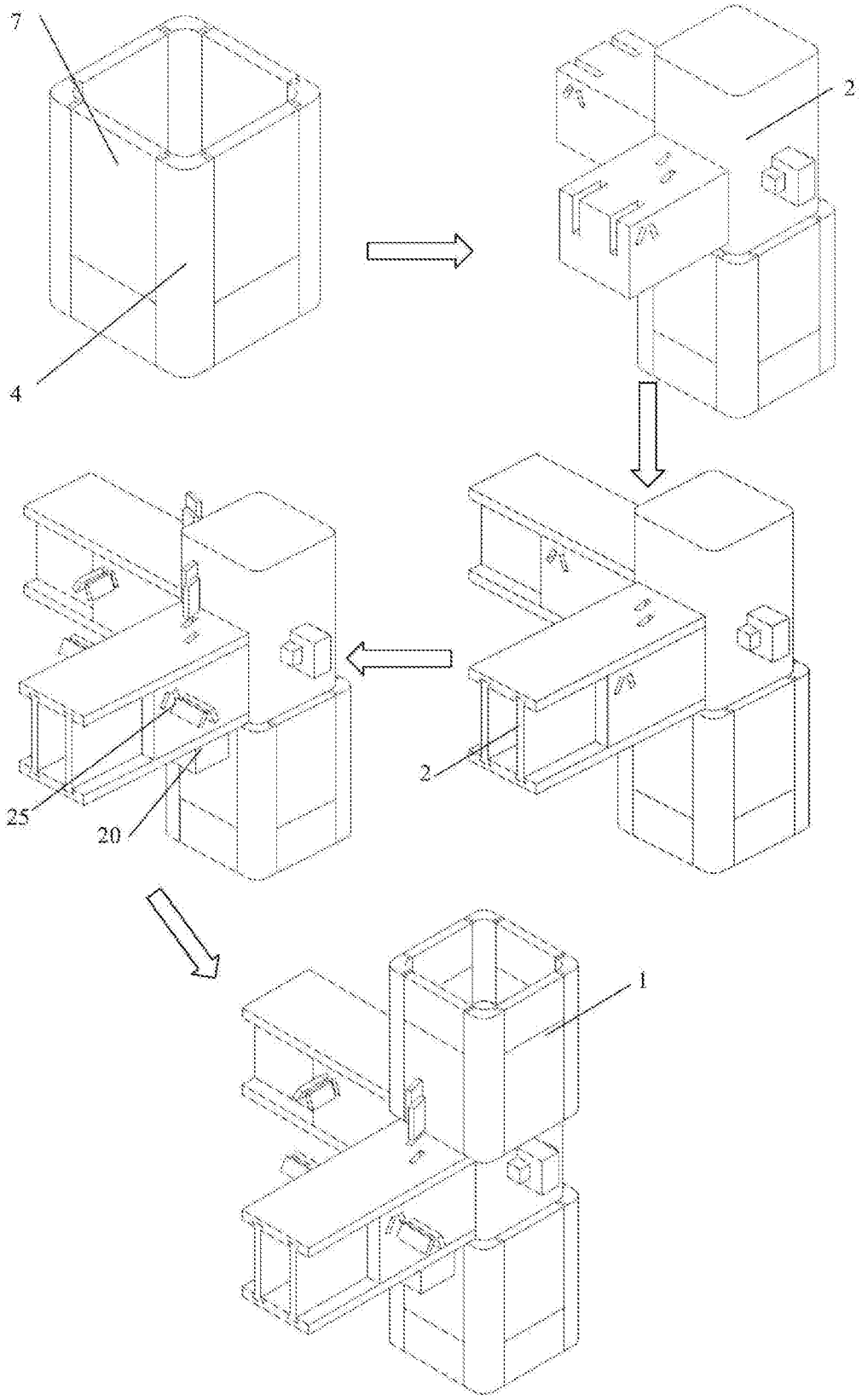
FIG. 14 is an assembly diagram of the corner column composite joint in Embodiment 2 of the invention.

Embodiment 2 differs from Embodiment 1 in the following aspects: the central column connecting assembly is replaced with a corner column connecting assembly, which, as shown in FIG. 11 and FIG. 14, adopts the same design principle as the central column connecting assembly. As shown in FIG. 12, the corner column connecting assembly comprises a square solid wood column, two second square wood beams (13 and 17) perpendicular to each other, and two wood wedges 26. I-shaped slots 27 are formed in two adjacent sides of the square solid wood column, an upper portion of the I-shaped slot 27 in one side penetrates through the entire solid wood column, a lower portion of the I-shaped slot in the other side penetrate through the entire solid wood column, I-shaped sliders 29 matched with the I-shaped slots are arranged on the second square wood beams (13 and 17), the I-shaped slider 29 on the second square wood beam 13 is arranged along the upper edge of the second square wood beam 13, the I-shaped slider 29 on the second square wood beam 17 is arranged along the lower edge of the I-shaped slider 29, the end faces of the I-shaped sliders are matched with the end faces of the I-shaped slots 27 in shape, and wood wedge holes 28 matched with the wood wedges 26 in size are formed in the ends of the I-shaped sliders 29. In this embodiment, a T-shaped splicing slot is formed in the lower side of each of the second square wood beams (13 and 17), two connecting slots corresponding to the connecting heads of the wood webs are formed in the tails of the second square wood beams (13 and 17), a design and assembly method identical with that of the central column connecting assembly is used for fixation, and the square wood beams are connected to the solid wood column along the I-shaped slots and are integrally fixed to the solid wood column with the wood wedges.

The invention has the following advantages: (1) compared with pure wood structures, the steel-wood composite structure has a higher vertical bearing capacity under the same cross-section due to the high lateral rigidity of steel; (2) compared with steel structures, the column side plates in this embodiment are wood structures, and the square pipe columns are hollow, so that the bearing capacity per unit mass is higher, the weight of the entire structure can be reduced to a certain extent, and the overall life is prolonged; (3) the beam flanges are tensioned, and the webs are sheared, so that compared with I-beams, local bending of the flanges is avoided, and compared with square wood beams, the material utilization rate is higher; (4) the whole joint can be assembled through simple splicing, and the components can be changed more easily under the seismic effect; the steel-wood composite structure formed by combining steel and wood has good seismic performance under the seismic effect due to the tenacity of wood; and (5) all the components can be prefabricated in factory and are spliced and connected on site, so that fully prefabricated construction is realized, quality problems caused by field welding are avoided, and the construction period is shortened.

The above embodiments are merely preferred ones of the invention, and are not intended to limit the invention in any forms. Any skilled in the art may apply equivalent embodiments obtained by modifying or transforming the technical contents disclosed above to other fields. Any simple amendments, equivalent modifications or transformations made to the above embodiments on the basis of the technical essence of the invention should also fall within the protection scope of the technical solutions of the invention.

What is claimed is:

1. A prefabricated steel-wood composite joint, comprising;

a plurality of square pipe columns, a plurality of steel-wood composite beams, and a beam-column connecting assembly configured for connecting the square pipe columns and the steel-wood composite beams, wherein:

each square pipe column comprises a plurality of connecting corner columns and a plurality of connecting side plates, wherein the connecting corner columns are steel columns, the connecting side plates are wood plates, and the square pipe column is of a hollow pipe column structure formed by splicing the connecting corner columns and the connecting side plates;

each steel-wood composite beam comprises a top flange, a bottom flange and a plurality of wood webs configured for connecting the top flange and the bottom flange, wherein the top flange and the bottom flange are arranged in parallel and are both steel structures comprising a plurality of flange insertion slots formed in inner sides, flange insertion heads matched with the flange insertion slots are formed m top and bottom sides of the wood webs, the wood webs are arranged between the top flange and the bottom flange and are perpendicular to the top flange and the bottom flange, and each wood web has an end flush with side faces of the top and bottom flanges and an end recessed in the top and bottom flanges and provided with a stepped connecting head; and the beam-column connecting assembly is a central column connecting assembly or a corner column connecting assembly, the beam-column connecting assembly is configured for connecting the square pipe columns and the steel-wood composite beams, and comprises a square solid timber piling matched with the square pipe columns in inner diameter, a plurality of square wood beams are arranged on side faces of the square solid timber piling, a plurality of connecting slots matched with the connecting heads are formed in ends of the square wood beams, and the square pipe columns and the steel-wood composite beams are connected through the square solid timber piling and the square wood beams, wherein a cross section of each connecting corner column is of an arc structure, a plurality of dovetail insertion grooves are formed in edges of two sides of each connecting corner column, a plurality of dovetail insertion heads matched with the dovetail insertion grooves are correspondingly arranged on side edges of the connecting side plates, and the dovetail insertion heads are inserted into the dovetail insertion grooves integrally connecting the connecting corner columns and the connecting side plates.

2. The prefabricated steel-wood composite joint according to claim 1, wherein each connecting side plate comprises an upper wood plate and a lower wood plate, wherein a linear insertion head is arranged at a lower end of the upper wood plate, a concave slot matched with the linear insertion head is formed in an upper end of the lower wood plate, and the upper wood plate is inserted into the lower wood plate to be as high as the connecting corner columns.

3. The prefabricated steel-wood composite joint according to claim 1, wherein the central column connecting assembly comprises the square solid timber piling and two sets of first square wood beams are correspondingly arranged in a skew-symmetric manner, wherein a plurality of T-shaped slots are formed in one pair of opposite sides of the square solid timber piling, and a plurality of first through holes penetrating through the square solid timber piling are formed in the T-shaped slots; and correspondingly, a plurality of inverted T-shaped slots are formed in another pair of opposite sides of the square solid timber piling, and a plurality of second through holes penetrating through the square solid timber piling are formed in the inverted T-shaped slots; and the first through holes are located in upper portions of the T-shaped slots, and the second through holes are located in lower portions of the inverted T-shaped slots.

4. The prefabricated steel-wood composite joint according to claim 3, wherein the two sets of first square wood beams include a first set of square wood beams and a second set of square wood beams, wherein the first set of square wood beams includes a first insertion head wood beam and a first special-shaped groove wood beam, a first strip-shaped insertion head is arranged on the first insertion head wood beam along an upper edge of a body of the first insertion head wood beam, a first special-shaped groove matched with the first strip-shaped insertion head in shape is formed in an upper surface of the first special-shaped groove wood beam, and after the first strip-shaped insertion head is inserted into the first through holes to be inlaid in the first special-shaped groove, two splicing slots are formed along two sides of the first special-shaped groove and are fixed with fixing wood sheets; and the second set of square wood beams includes a second insertion head wood beam and a second special-shaped groove wood beam, wherein a second strip-shaped insertion head is arranged on the second insertion head wood beam along a lower edge of a body of the second insertion head wood beam, a second special-shaped groove matched with the second strip-shaped insertion head in shape is formed in a lower surface of the second special-shaped groove wood beam, and after the second strip-shaped insertion head is inserted into the second through holes to be inlaid in the second special-shaped groove, two splicing slots are formed along two sides of the second special-shaped groove, and the first set of square wood beams and the second set of square wood beams are matched in design and are exactly connected integrally.

5. The prefabricated steel-wood composite joint according to claim 4, wherein the corner column connecting assembly comprises the square solid timber piling, two second square wood beams perpendicular to each other, and two wood wedges, wherein a plurality of I-shaped slots are respectively formed in two adjacent sides of the square solid timber piling, an upper portion of the I-shaped slot in one side penetrates through the entire square solid timber piling, a lower portion of the I-shaped slot in the other side penetrates through the entire square solid timber piling, a plurality of I-shaped sliders matched with the I-shaped slots are arranged on the second square wood beams, the I-shaped slider on one of the two second square wood beams is arranged along an upper edge of the same second square wood beam, the I-shaped slider on a remainder of the two second square wood beams is arranged along a lower edge of the remainder of the two second square wood beams, and a plurality of wood wedge holes matched with the wood wedges are formed in ends of the I-shaped sliders.

6. The prefabricated steel-wood composite joint according to claim 5, wherein the connecting slots corresponding to the connecting heads of the wood webs are formed in tails of the first insertion head wood beam, the first special-shaped groove wood beam, the second insertion head wood beam, the second special-shaped groove wood beam and second square wood beams.

7. The prefabricated steel-wood composite joint according to claim 6, wherein a plurality of fixing slots are formed in two side faces of the first insertion head wood beam, the first special-shaped groove wood beam, the second insertion head wood beam, the second special-shaped groove wood beam and the second square wood beams, and a plurality of fixing wood sheets are arranged in the fixing slots.

8. The prefabricated steel-wood composite joint according to claim 7, further comprising a plurality of I-shaped sliding blocks and filling wood blocks, wherein a plurality of T-shaped splicing slots are formed in lower sides of the first insertion head wood beam, the first special-shaped groove wood beam, the second insertion head wood beam, the second special-shaped groove wood beam and the second square wood beams, a plurality of T-shaped through holes matched with the T-shaped splicing slots are correspondingly formed in the bottom flanges, a sliding space is formed in each T-shaped splicing slot, a splicing head matched with the sliding space is arranged on a lower portion of each I-shaped sliding block, the I-shaped sliding blocks are inserted into the T-shaped splicing slots and slide in the T-shaped splicing slots, and then the filling wood blocks are inserted into the T-shaped splicing slots to be fixed.

* * * * *